US006394319B1

(12) United States Patent
Pucillo

(10) Patent No.: US 6,394,319 B1
(45) Date of Patent: May 28, 2002

(54) FLEXIBLE LIQUID FEEDING ASSEMBLY

(76) Inventor: Robert Pucillo, 14275 SW. 99 La., Miami, FL (US) 33196

( * ) Notice: Subject to any disclaimer, the term of this patent is extended or adjusted under 35 U.S.C. 154(b) by 0 days.

(21) Appl. No.: 09/717,774

(22) Filed: Nov. 21, 2000

(51) Int. Cl.[7] ..... B67D 5/40

(52) U.S. Cl. ..... 222/383.1; 222/189.1; 222/464.4

(58) Field of Search ..... 222/189.1, 383.1, 222/464.3, 464.4, 490

(56) References Cited

U.S. PATENT DOCUMENTS

| | | | | |
|---|---|---|---|---|
| 3,211,349 A | | 10/1965 | Prussin et al. | 222/394 |
| 3,547,296 A | | 12/1970 | Greenberg | 215/11 |
| 3,580,430 A | | 5/1971 | Angele | 222/394 |
| 4,273,272 A | | 6/1981 | Blanc | 222/464 |
| 4,830,235 A | | 5/1989 | Miller | 222/464 |
| 4,940,152 A | * | 7/1990 | Lin | 222/464.4 |
| 5,195,664 A | | 3/1993 | Rhea | 222/464 |
| 5,551,605 A | * | 9/1996 | Bethlendy | 222/464.4 |
| 5,873,474 A | * | 2/1999 | Gray | 222/464.4 |
| 5,934,519 A | * | 8/1999 | Kim et al. | 222/464.4 |

* cited by examiner

*Primary Examiner*—Joseph A. Kaufman
(74) *Attorney, Agent, or Firm*—Yi Li

(57) ABSTRACT

A flexible liquid feeding assembly as an add-on device for use with liquid dispensing bottles is disclosed. The flexible liquid feeding assembly contains a flexible tube and a weight feeder for feeding liquid into a liquid dispenser of a liquid dispensing bottle. The flexible tube has a high degree of flexibility, and the weight feeder has a sufficient weight. Such structural features enable the weight feeder to move in the same direction of liquid's movement in the dispensing bottle. Therefore, the flexible liquid feeding assembly provides a continuous liquid supply regardless the bottle's orientations, even when the bottle is in an inverted position. Alternatively, a weight blocker can be used in conjunction with liquid feeding holes on the side of flexible tube. A liquid dispensing bottle containing a flexible liquid feeding assembly is also disclosed. The flexible tube is sufficiently long that the weight feeder or weight blocker can reach and be in contact with bottom and side walls of the container, and be in contact with a connector of the liquid dispenser when the bottle is inverted, so that the bottle enables to dispense liquid when the bottle is in an inverted position.

20 Claims, 7 Drawing Sheets

FLEXIBLE LIQUID FEEDING ASSEMBLY

FIELD OF THE INVENTION

The present invention relates to a flexible liquid feeding assembly for dispensing liquid in a liquid dispensing bottle which can be titled in any direction including a completely inverted position.

BACKGROUND OF THE INVENTION

Spray bottles commonly include a liquid dispenser, or spray head, with a pumping mechanism. The pump has a liquid intake port which is commonly connected to a rigid feeding tube extending from the lower region of the liquid dispenser into the lower region of a spray bottle or a liquid container.

A problem exists in that the conventional spray bottle, when inverted or substantially tilted, does not feed liquid through the tube into the pumping mechanism in the liquid dispenser. This failure to suction liquid is due to the fact that the rigid feeding tube is disposed above the level of liquid when the spray bottle is in a substantially tilted or an inverted position.

U.S. Pat. No. 4,273,272 (to Blanc) teaches a liquid dispenser, which includes a flexible tube and a heavy intake fitting. The intake fitting has a longitudinally extending passage with a complex internal structure.

U.S. Pat. No. 5,195,664 (to Rhea) teaches an all directional fluid pick-up which comprises a flexible dip tube, a connecting means, a pick-up head and a conduit means carried by the pick-up head. The pick-up head is composed of two portions, the first having low density and being buoyant in liquid to exert a self-righting influence, and the second having higher density and being non-buoyant. The conduit means extends through the first and second portions of the pick-up head, and connected to the flexible dip tube.

Both prior art utilizes complex liquid intake fitting or pick up head structures, which increases the cost of manufacturing and the products, and renders implementation of the techniques to those low cost household spray bottles financially less feasible. Presently, the household liquid dispensing bottle market is dominated by those products having conventional rigid feeding tubes. Furthermore, the prior art fails to teach how to continuously dispensing liquid when the bottles are in an inverted position.

Therefore, a need rises for low cost liquid feeding assemblies. It is desirable that the liquid feeding assemblies are retrofitable to the existing spray bottles and drinking bottles owned by millions of families, and are accessible by customers as after-market products.

SUMMARY OF THE INVENTION

The present invention relates to flexible liquid feeding assemblies and their use in liquid dispensing bottles or containers for continuously dispensing liquid when the liquid dispensing bottles are in any direction, including inverted position.

The flexible liquid feeding assembly comprises a flexible tube with a first end for connecting with a liquid dispenser of a liquid dispensing bottle, and a weight feeder comprising a center channel with one opening at one end of the channel connected to a second end of the flexible tube, and a liquid intake opening at the opposite end of the channel for feeding liquid through the channel into the flexible tube for dispensing.

Alternatively, the flexible liquid feeding assembly comprises a flexible tube with a first end for connecting with a liquid dispenser of a liquid dispensing bottle, and a liquid intake hole on a side of the flexible tube near a second end of the flexible tube for feeding liquid into the flexible tube for dispensing, and a weight blocker connected to the second end of the flexible tube which blocks liquid feeding into the flexible tube directly through the second end.

Furthermore, the present invention relates to a liquid dispensing bottle containing a flexible liquid feeding assembly. The liquid dispensing bottle comprises a liquid dispenser having an intake port and a connector; a container connected to the liquid dispenser; a flexible tube with a first end connected to the liquid dispenser; a weight feeder or weight blocker connected to a second end of the flexible tube, wherein a combined length of the flexible tube and weigh feeder is sufficiently long that the weight feeder or weight blocker can reach and be in contact with the bottom and side walls of the container, and be in contact with the connector of the liquid dispenser when the bottle is in an inverted position, so that the liquid dispensing bottle enables to dispense liquid when the liquid dispensing bottle is in an inverted position. When a weight blocker is used, the flexible tube has liquid intake holes on the side of the tube for liquid feeding.

The flexible tube is sufficiently flexible that allows the weight feeder or blocker to move freely with liquid when used inside a liquid dispensing bottle. The weight feeder or blocker has a sufficient weight so that the weight feeder or blocker moves in the same direction of liquid's movement inside the liquid dispensing bottle. The weight feeder or the liquid intake opening of the flexible tube stays under the surface of liquid when the liquid dispensing bottle is tilted in any direction, even when the bottle is in a completely inverted position.

The flexible liquid feeding assembly of the present invention solves the common problems with existing spray bottles that have difficulties to supply liquid for dispensing when the bottles are tilted, or completely fail to supply liquid when the bottles are inverted. The flexible liquid feeding assembly can also be used with children's milk or drink bottles, where a child can drink the liquid regardless the bottles' orientations.

The flexible liquid feeding assemblies can be packed in a kit, and sold as an add-on device for use with existing liquid dispensing bottles. Moreover, a flexible liquid feeding assembly coupled with a liquid dispenser can be sold as a unit with or without the container.

DETAILED DESCRIPTION OF THE INVENTION

A regular liquid dispensing bottle usually includes a liquid dispenser which has a liquid dispensing mechanism, an intake port and a connector; a liquid container connected to the liquid dispenser; and a liquid feeding tube.

The present invention relates to flexible liquid feeding assemblies and their use in liquid dispensing bottles or containers for continuously dispensing liquid when the liquid dispensing bottles are in any direction, including inverted position.

Figure 1A:
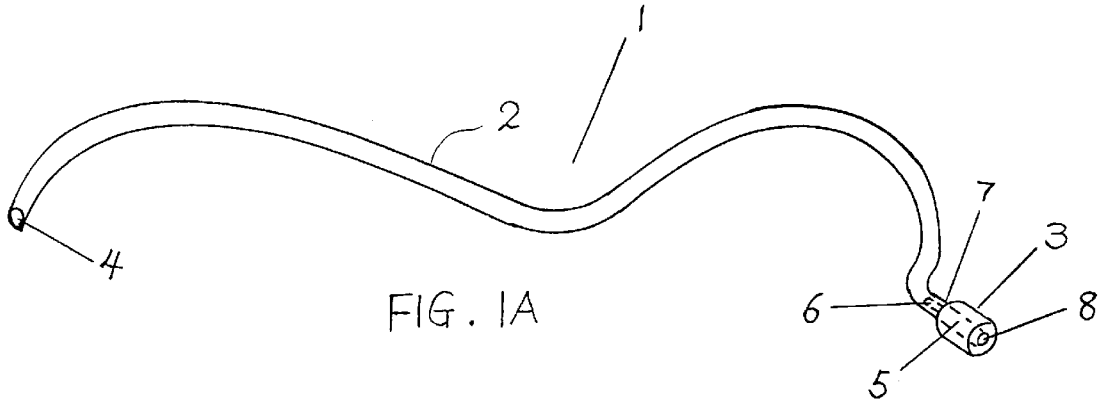
FIG. 1A shows the flexible liquid feeding assembly of one embodiment, which has a weight feeder.

In one embodiment, the flexible liquid feeding assembly 1 comprises a flexible tube 2 and a weight feeder 3, as illustrated in FIG. 1A. The flexible tube has two ends, wherein the first end 4 is for connecting with the liquid dispenser of a liquid dispensing bottle. The weight feeder has a center channel 5 with one opening 6 at one end of the channel connected to the second end 7 of the flexible tube, and a liquid intake opening 8 at the opposite end of the channel for feeding liquid through the channel into the flexible tube for dispensing.

The flexible tube is sufficiently flexible, which allows the weight feeder to move freely with liquid when used inside a liquid dispensing bottle. The flexible tube can be made of silicone, soft plastic, rubber and other suitable materials.

Figure 2:
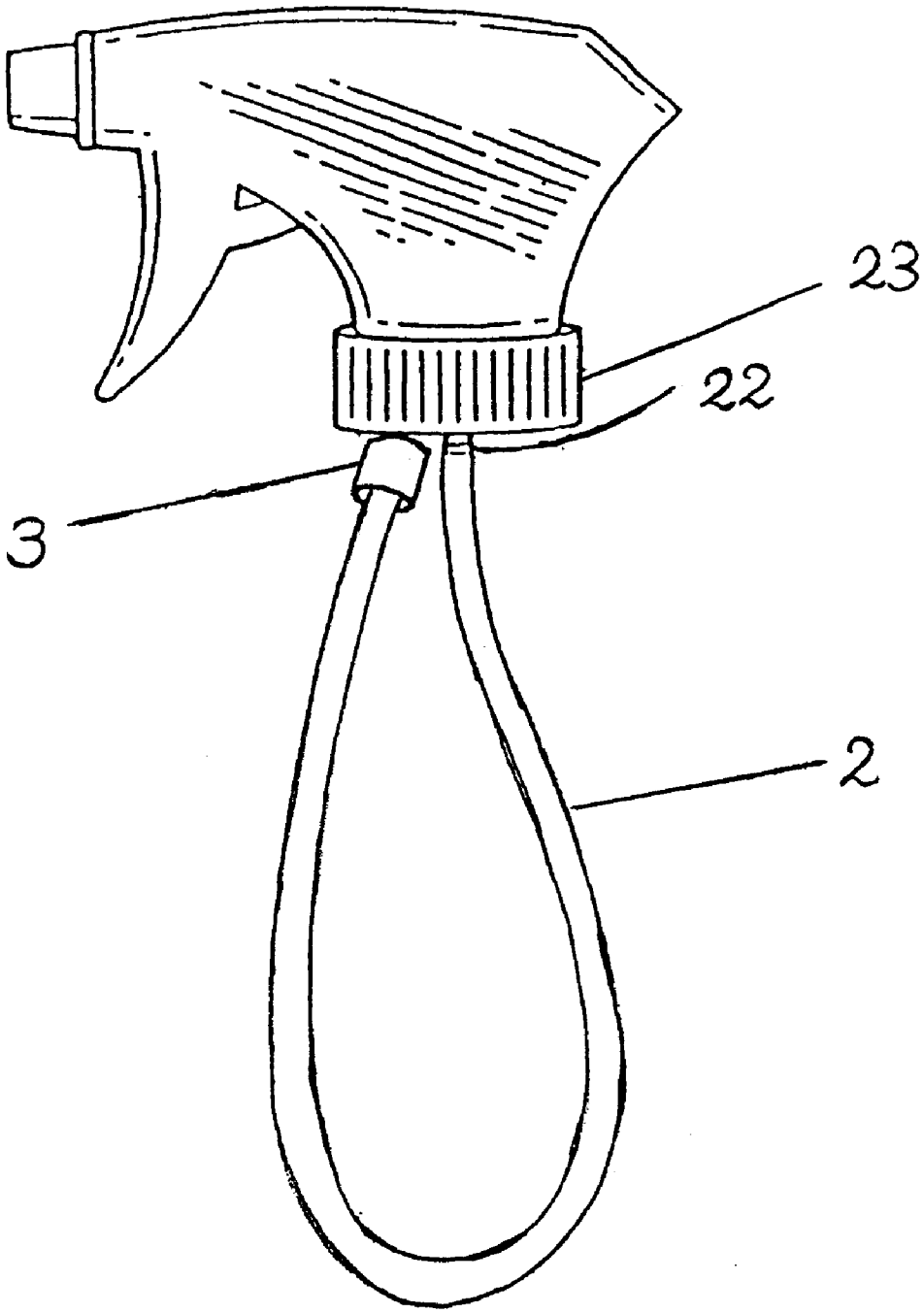
FIG. 2 illustrates a sufficient length of the flexible tube which enables the weight feeder to reach and in contact with the connector of a liquid dispenser when a liquid dispensing bottle is in an inverted position.

It is important that the flexible tube has a sufficient length so that the connected weight feeder can reach and be in contact with bottom and side walls of the container, and be in contact with the connector of the liquid dispenser when the bottle is in an inverted position, as shown in FIG. 2. With this structural feature, the liquid dispensing bottle enables to dispense liquid when the liquid dispensing bottle is substantially titled, and even in an inverted position. As illustrated in the figure, due to a high degree of flexibility of the flexible tube, no pinching or sharp bending of the tube occurs. Therefore, no additional connecters are required to link different portions of the feeding tube to provide a continuous liquid feeding, as those seen in the prior art.

The weight feeder should have sufficient weight so that the weight feeder can move with liquid inside the liquid dispensing bottles when the bottles are tilted. The movement of liquid and the weight feeder are controlled by the gravity. Therefore, they move in the same directions. Because of the weight, the weight feeder is nonbuoyant and it stays under the surface of liquid. This property insures a continuous feeding of liquid through the intake opening of the weight feeder into the flexible tube, and further to the liquid dispenser. In particular, when there is only a small amount of liquid remains in the bottle, the weight feeder is still able to pick up the liquid. Furthermore, since the flexible tube has a high degree of flexibility, the flexible liquid feeding assembly of the present invention is able to feed liquid for dispensing even when the bottle is completely inverted without pinching the tube.

Figure 1B:
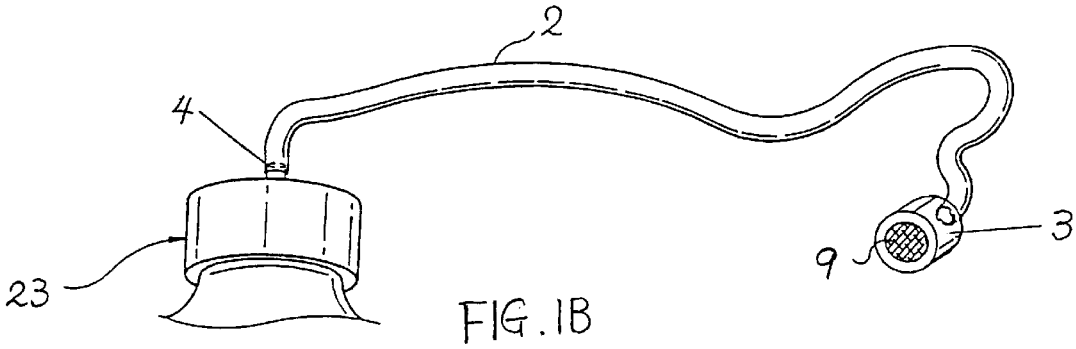
FIG. 1B shows the flexible liquid feeding assembly of another embodiment, wherein there is a screen on the liquid intake opening of the weight feeder for preventing blocking by debris.

The weight feeder can further comprise a screen 9 covering the liquid intake opening to prevent particles or debris getting into the liquid dispenser, as shown in FIG. 1B.

The weight feeder can be made of variety of materials. Feasible examples include metals, ceramics, glass, and high density plastics. The density of the materials should be greater than 1.0 g/cm$^3$. Additionally, the weight feeder can be coated with chemically inert materials.

Figure 3:
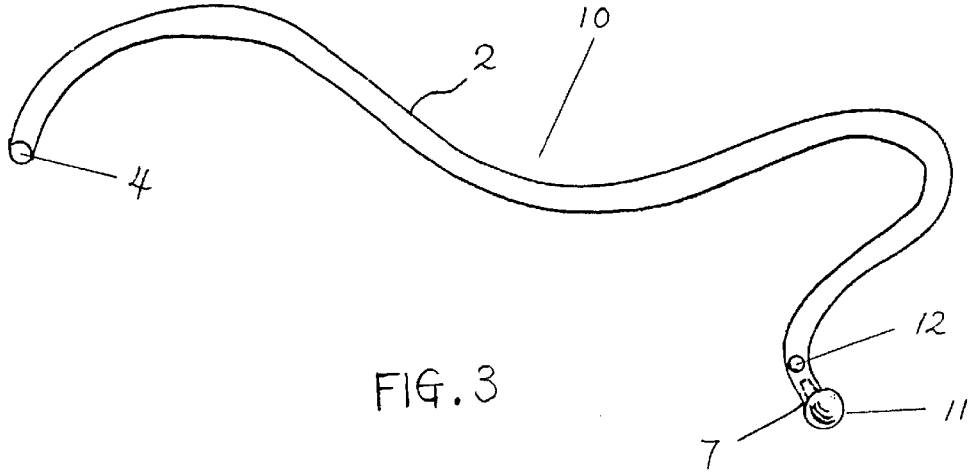
FIG. 3 shows the flexible liquid feeding assembly having a weight blocker from one embodiment of the present invention.

In an alternative embodiment, the flexible liquid feeding assembly 10 comprises a flexible tube 2 and a weight blocker 11. FIG. 3 illustrates a flexible liquid feeding assembly which has the flexible tube connected to a weight blocker. In this case, the flexible tube has a liquid intake hole 12 on the side of the tube near the second end of the flexible tube for feeding liquid into the tube. The weight blocker is connected to the second end 7 of the flexible tube, which blocks liquid feeding into the flexible tube directly through the second end. In this configuration, the weight blocker is a solid block with minimal structural requirements. Therefore, its manufacture cost is lower. The external side of the weight blocker can be spherical as shown in FIG. 3, which can further enhance smooth movement of the weight blocker with liquid due to reduced surface contact between the interior surface of the bottle and the weight blocker. Other suitable shapes can also be used depending on the specific situation. There can be one or multiple liquid intake holes on the side of the flexible tube depending on the liquid intake rate needed in a particular application. Therefore, this embodiment also provides flexibility in controlling liquid intake rate, in comparison to a fixed diameter of the liquid intake opening of the weight feeder. The connection between the flexible tube and the weight blocker is below the liquid intake hole on the wall of the flexible tube, and not interfering liquid feeding. The weight blocker is sufficiently short so that the distance between the liquid intake hole and the bottom of the blocker is short, which provides a sufficient liquid pick up when the level of liquid is low.

Figure 4:
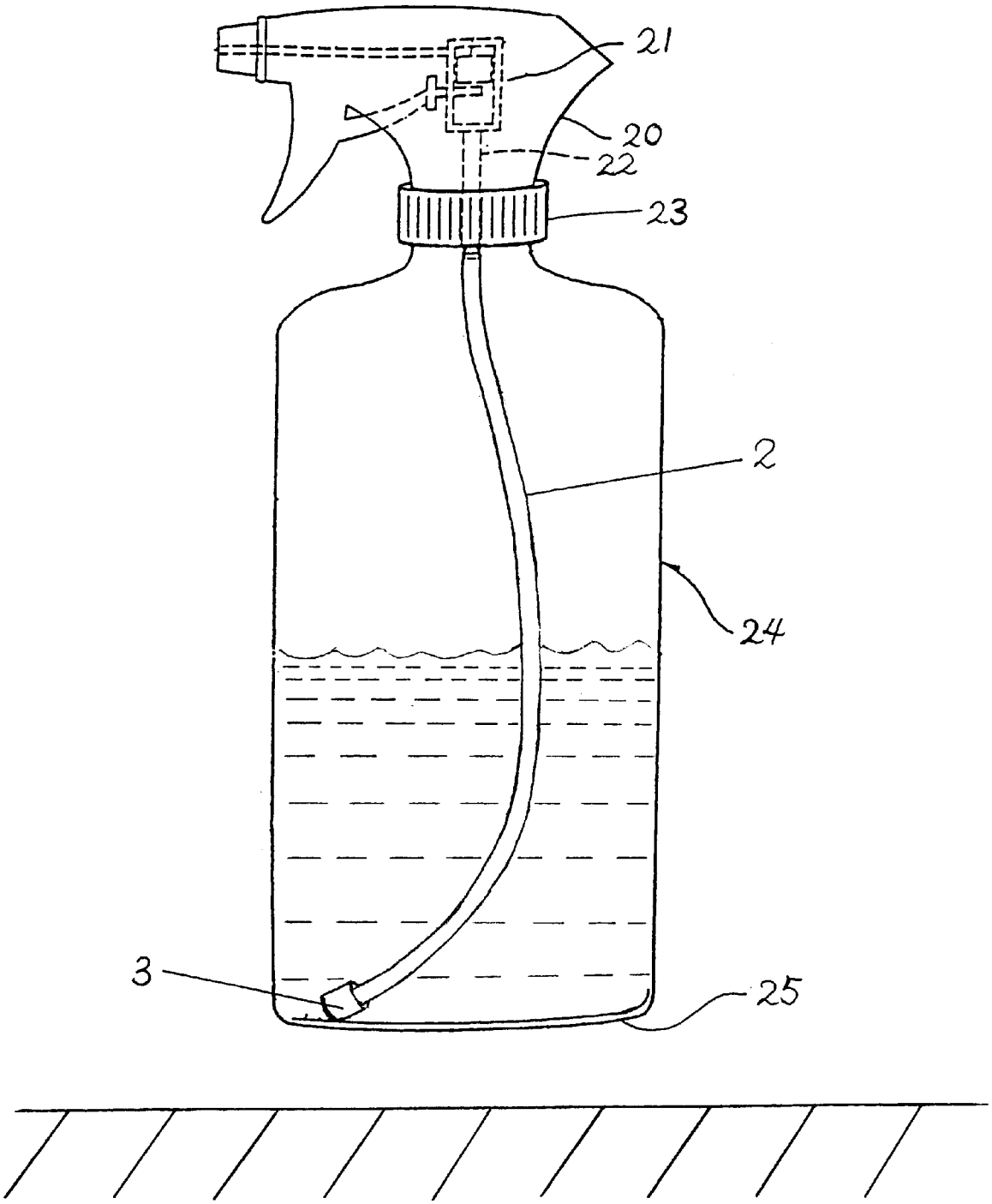
FIG. 4 shows a spray bottle in an upright position with the flexible liquid feeding assembly of the present invention.

FIG. 4 illustrates an example of incorporating the flexible liquid feeding assembly into a conventional spray bottle, which is in an upright position. The spray bottle has a liquid dispenser, or spray head, 20. The liquid dispenser has a pumping mechanism 21, an intake port 22, and a connector 23 for connecting to the liquid container 24. As shown, the flexible liquid feeding assembly is connected to the intake port 22 of the liquid dispenser. Because of the weight imposed by the weight feeder, the flexible tube extends down to the bottom 25 of the liquid container. Once the liquid dispenser is triggered, liquid is fed into pump mechanism 21 through the flexible liquid feeding assembly.

Figure 5A:
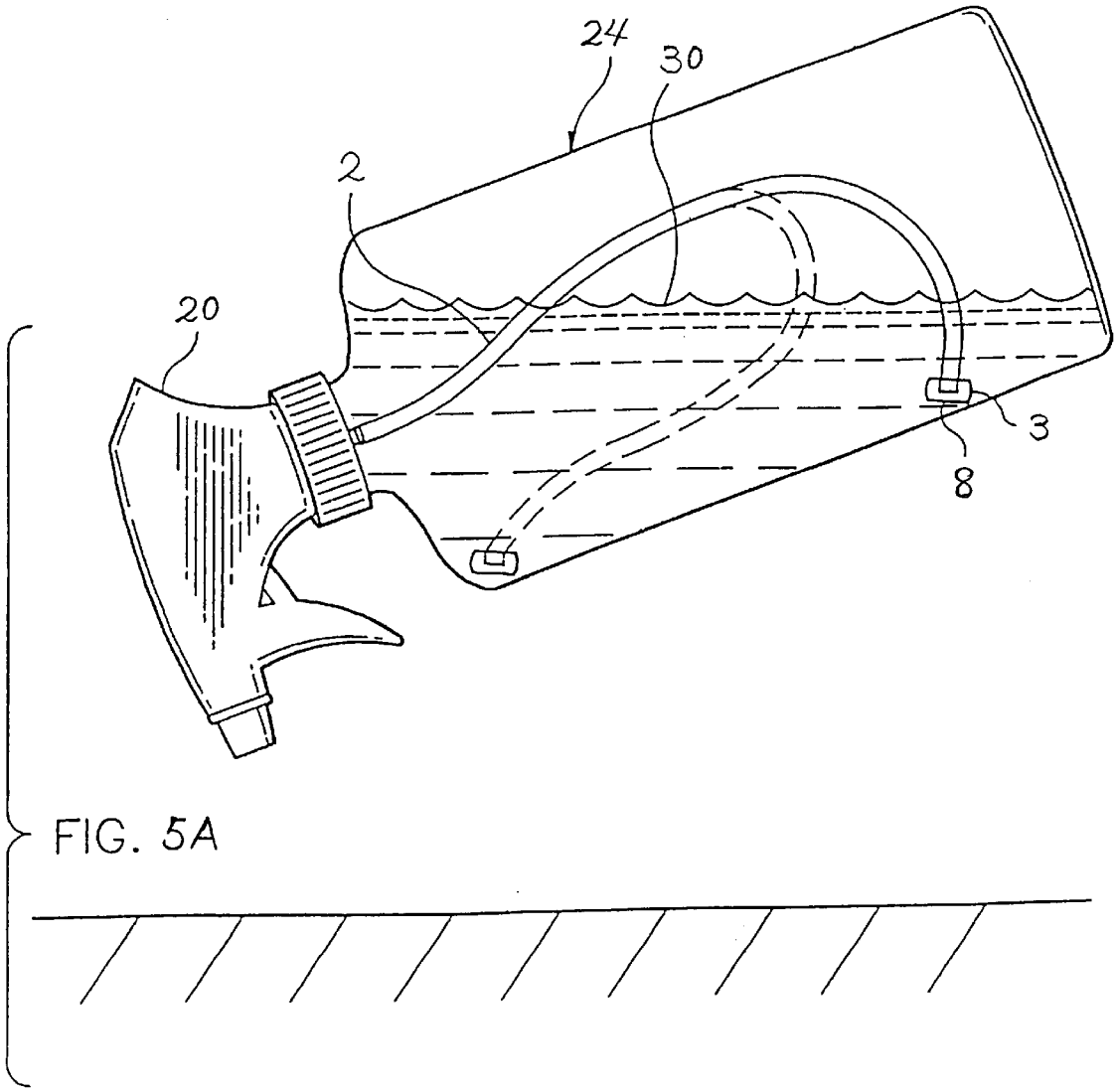
FIGS. 5A and 5B show a spray bottle in a tilted and in an inverted position respectively, which demonstrate the operating mechanism of the flexible liquid feeding assembly of the present invention.

FIG. 5A illustrates the operating mechanism of the flexible liquid feeding assembly when the bottle is substantially tilted. As shown, the weight feeder, or weight blocker, slides in the same direction of liquid because of gravity. Therefore, the weight feeder always stays under surface 30 of liquid regardless the direction of tilting. Since the flexible tube is highly flexible, it moves freely with the weight feeder or weight blocker without sharp bending or pinching. This feature provides continuous liquid feeding when the user has drastic movements of the bottle's orientations, which commonly occurs when people do house cleanings.

Figure 5B:
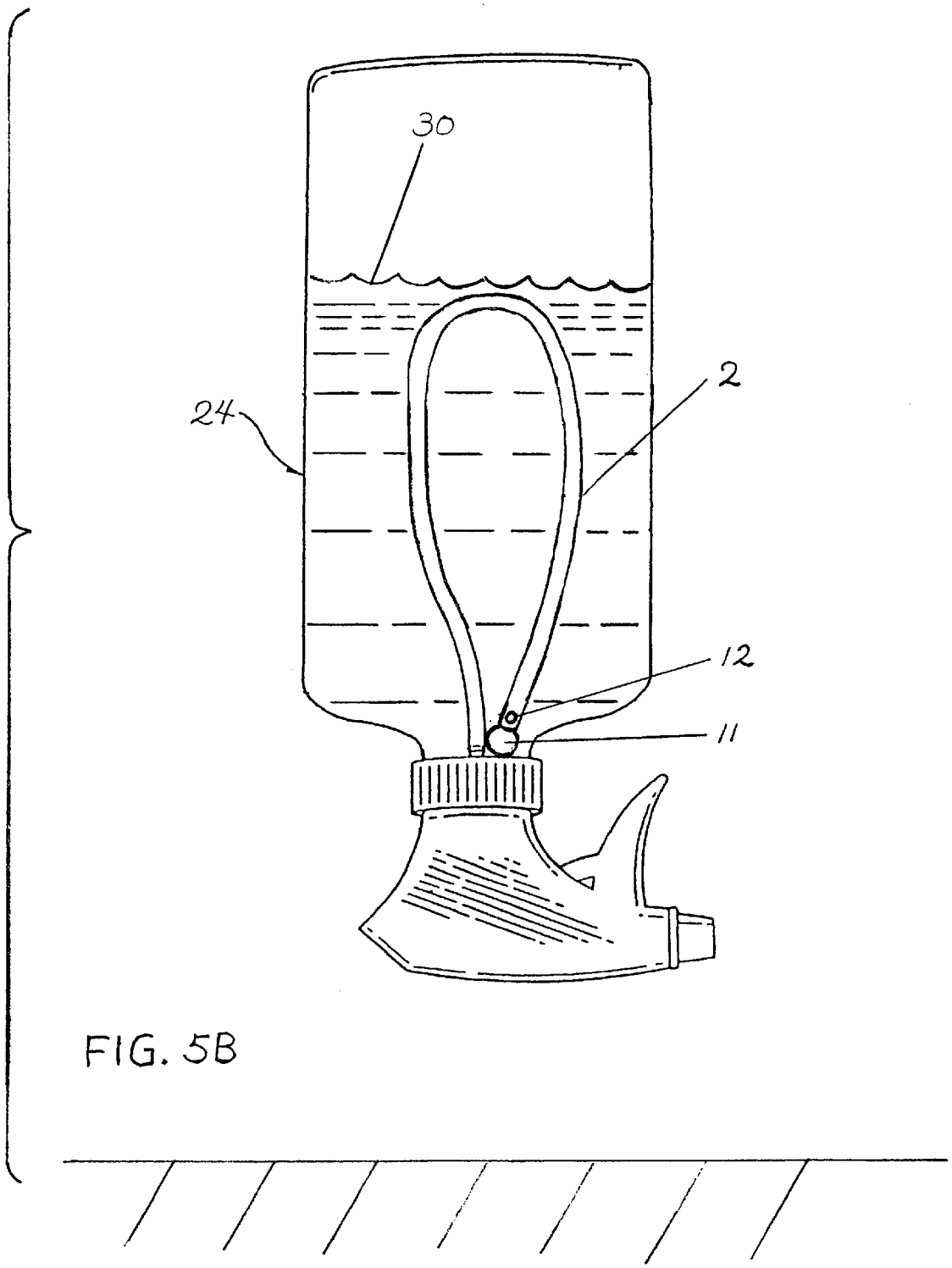

FIG. 5B illustrates an extreme condition of the liquid dispensing bottle's position. The bottle is completely inverted from its upright position. This frequently occurs when people try to spray body lotion to their back or to their lower legs. As shown, the weight blocker (or a weight feeder) has moved 180° from where it was when the bottle was in an upright position. However, it still remains under the surface of liquid.

As exemplified by FIGS. 4, 5A and 5B, the utility and advantages of the flexible liquid feeding assembly of the present invention in our daily life are apparent. Therefore, the flexible liquid feeding assembly of the present invention provides solutions to the common problems with existing spray bottles that have difficulties to supply liquid for dispensing when the bottles are tilted, or completely fail to supply liquid when the bottles are inverted.

Figure 6:
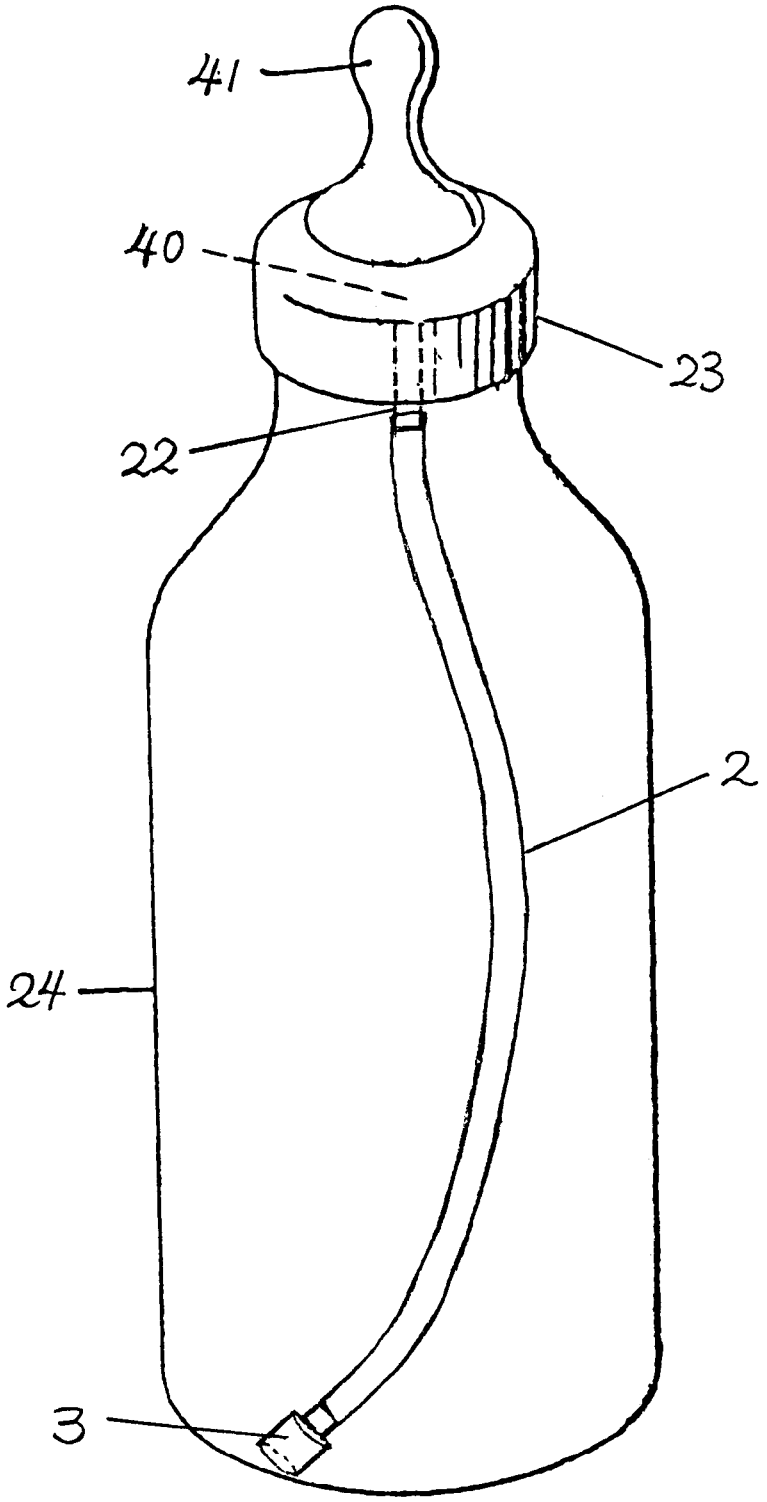
FIG. 6 shows a milk bottle in an upright position with the flexible liquid feeding assembly of the present invention.

A reverse situation occurs when the flexible liquid feeding assembly of the present invention is retrofit to children's milk or drinking bottles. Normally, a milk bottle only has a nipple as a dispensing mechanism and a container. Milk is dispensed by suction when the bottle is inverted from its upright position. When children, most likely toddlers, walk around with the bottles in their hands, they will not be able to drink milk without substantially tilting or inverting the bottle. To do so, they also need to lift up their heads, which frequently causes falling of the children due to loss of balance. Using the flexible liquid feeding assembly of the present invention incorporated with existing milk or drinking bottles, a child can drink the liquid regardless the orientations of the bottle in his or her hands. FIG. 6 illustrates such an application. In this case, there is an internal feeding plug 40 (details not shown) under the suction mechanism 41. The internal feeding plug 40 has a liquid intake port 22 for connecting to the flexible tube 2.

Figure 7A:
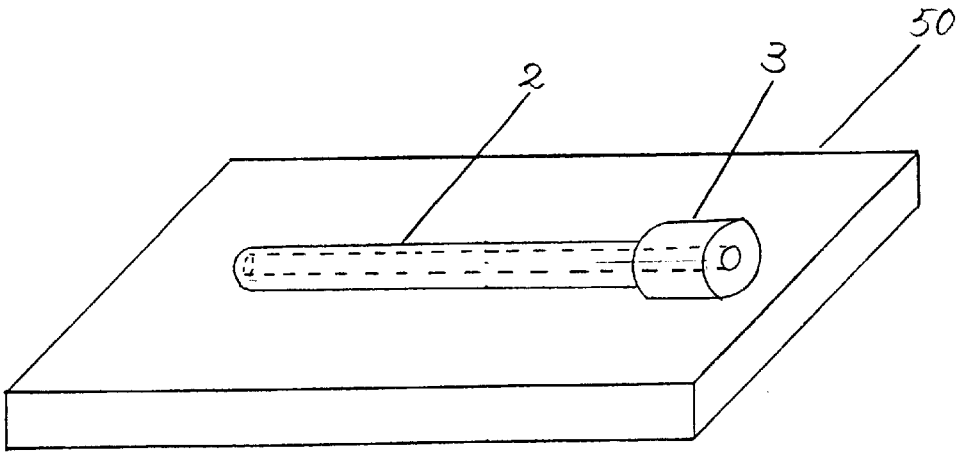
FIGS. 7A and 7B show two kits of the flexible liquid feeding assemblies of the present invention.
Figure 7B:
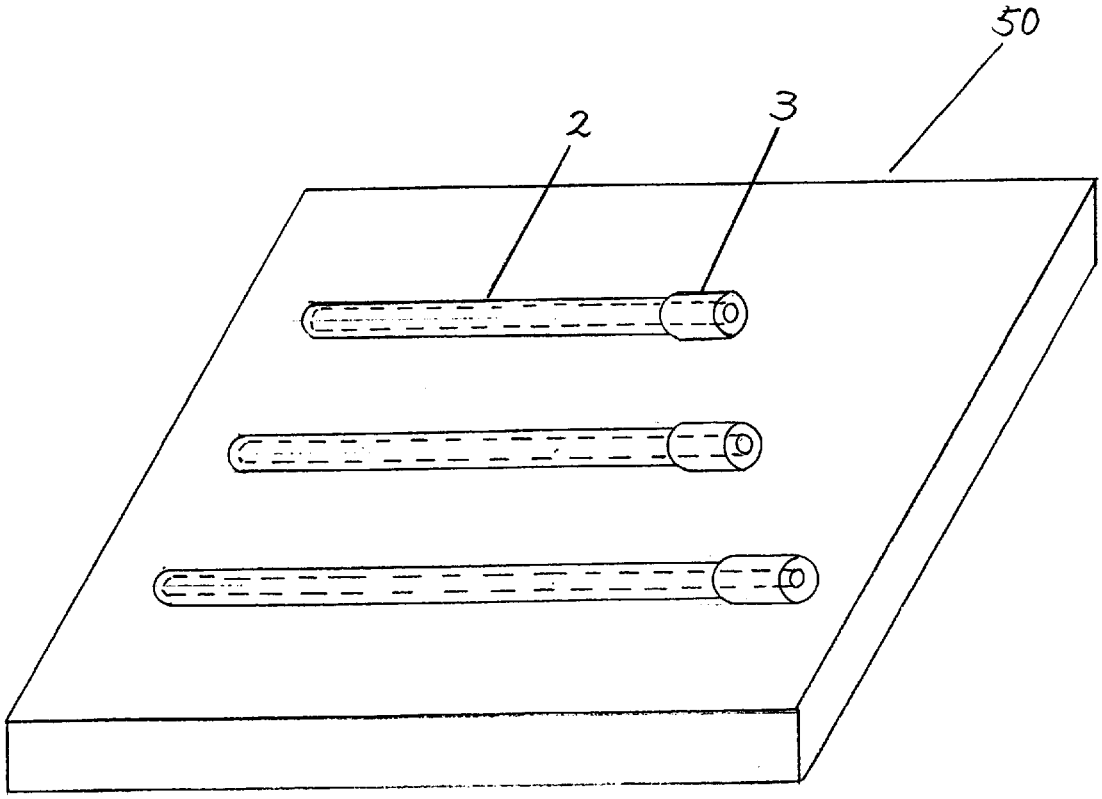

The flexible liquid feeding assembly can be sold as a kit to be used as an add-on device to existing liquid dispensing bottles. FIGS. 7A and 7B show two different kits 50. One has one set of flexible liquid feeding assembly. The other has multiple sets of the flexible liquid feeding assemblies with different tube length. The diameters of the tubes can also be different for retrofitting to different intake port of liquid dispensing bottles. The flexible liquid feeding assembly can also have ornamental designs, such as different colors of tube, and different colors and shapes of weight feeders and weight blockers. The decorative features can be desirable in certain applications such as perfume bottles, children's milk or drinking bottles.

The kit can also include instructions on how to use the flexible liquid feeding assembly with existing liquid dispensing bottles. The rigid feed tube, commonly used in conjunction with conventional liquid dispensing bottles, is removed by simply pulling the rigid tube from liquid intake port 22 of the liquid dispenser. The intake port 22 may be a female port or a male port leading to the pump mechanism 21. The flexible liquid feeding assembly sold in the kit can be installed on conventional liquid dispensing bottles simply by sliding the first end 4 of flexible tube over liquid intake port 22 of pumping mechanism 21. Due to the flexibility of the flexible tube, a short, rigid tube or coupler may be used to couple the flexible tube to the female port. The short, rigid coupler is inserted into the female port and the opposite end of the coupler fits in the first end 4 of the flexible tube. Otherwise, the consumer may cut the existing, rigid feed tube near intake port 22 and fit the first end 4 of the flexible tube over the short stub of the truncated rigid feed tube.

To enforce the connection of the flexible tube with the intake port 22 of the dispenser, additional connection means can also be used. Suitable examples of connection means include clips and elastic rings, which can tighten and hold the flexible tube on the intake port. To provide ease of use, the kit can also include the connection means, and the coupler. The kit instruction also includes how to determine an appropriate length of the flexible tube to ensure liquid dispensing when the bottles are in an inverted position.

Furthermore, a flexible liquid feeding assembly coupled with a liquid dispenser can be sold as a unit in a kit, or sold with a liquid dispensing bottle.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A kit of flexible liquid feeding assembly comprising:

(a) a flexible tube with two ends, wherein a first end is for connecting with a liquid dispenser of a liquid dispensing bottle, and (b) a weight feeder connected to the inside of a second end of said flexible tube, wherein said weight feeder consists of a center channel with one opening at one end, and a liquid intake opening at the opposite end of said channel for feeding liquid through said channel into said flexible tube for dispensing.

2. The kit of flexible liquid feeding assembly of claim 1, wherein said flexible tube is sufficiently flexible that allows said weight feeder to move freely with liquid when used inside said liquid dispensing bottle.

3. The kit of flexible liquid feeding assembly of claim 2, wherein said flexible tube is selected from the group consisting of silicone tube, soft plastic tube, and rubber tube.

4. The kit of flexible liquid feeding assembly of claim 1, wherein said weight feeder has a sufficient weight so that said weight feeder moves with liquid inside said liquid dispensing bottle, and said liquid intake opening stays under surface of liquid when said liquid dispensing bottle is tilted in any direction.

5. The kit of flexible liquid feeding assembly of claim 4, wherein said weight feeder is made from materials having density greater than 1.0 g/cm$^3$.

6. The kit of flexible liquid feeding assembly of claim 5, wherein said materials are selected from the group consisting of metal, ceramic, glass, and high density plastics.

7. The kit of flexible liquid feeding assembly of claim 1 further comprising a connection means for enforcing connection of said flexible tube with an intake port of said liquid dispenser.

8. The kit of flexible liquid feeding assembly of claim 1 further comprising a liquid dispenser which has a liquid dispensing mechanism, an intake port, and a connector for connecting to a liquid container.

9. The kit of flexible liquid feeding assembly of claim 8, wherein said liquid dispensing mechanism is a pumping mechanism for spraying.

10. The kit of flexible liquid feeding assembly of claim 8, wherein said liquid dispensing mechanism is a suction mechanism for attracting liquid from said liquid dispensing bottle, and further comprises an internal feeding plug.

11. A kit of flexible liquid feeding assembly consisting essentially of:

(a) a flexible tube having two ends, with a first end for connecting with a liquid dispenser of a liquid dispensing bottle, and at least one liquid intake hole on a side of said flexible tube near a second end of said flexible tube for feeding liquid into said flexible tube for dispensing, and (b) a weight blocker capable of being connected to said second end of said flexible tube for blocking liquid entering from said second end of said flexible tube.

12. The kit of flexible liquid feeding assembly of claim 11, wherein said flexible tube is sufficiently flexible that allows said weight feeder to move freely with liquid when used inside said liquid dispensing bottle.

13. The kit of flexible liquid feeding assembly of claim 11, wherein said weight blocker is made from materials having density greater than 1.0 g/cm$^3$, and said weight blocker has sufficient weight so that said weight blocker moves with liquid inside said liquid dispensing bottle, and said liquid intake hole stays under surface of liquid when said liquid dispensing bottle is tilted in any direction.

14. A liquid dispensing bottle containing a flexible liquid feeding assembly consisting of:

(a) a liquid dispenser having a liquid dispensing mechanism, an intake port, and a connector, (b) a container connected to said liquid dispenser through said connector, (c) a sufficient length of flexible tube with a first end connected to said intake port of said liquid dispenser, (d) a weight connected to the inside of a second end of said flexible tube, and (e) a liquid intake opening for feeding liquid into said flexible tube, wherein said sufficient length of flexible tube enables connected weight to reach and be in contact with bottom and side walls of said container, and be in contact with said connector of said liquid dispenser when said bottle is in an inverted position, so that said liquid dispensing bottle can dispense liquid when said bottle is in an inverted position.

15. The liquid dispensing bottle of claim 14, wherein said weight is a weight feeder comprising a center channel with one opening at one end which is connected to said second end of said flexible tube, and said liquid intake opening at the opposite end of said channel for feeding liquid through said channel into said flexible tube for dispensing.

16. The liquid dispensing bottle of claim 14, wherein said weight is a weight blocker, and said liquid intake opening is a liquid intake hole on a side of said flexible tube near said second end of said flexible tube for feeding liquid into said flexible tube for dispensing.

17. The liquid dispensing bottle of claim 14, wherein said flexible tube is sufficiently flexible that allows said weight to move freely with liquid inside said container.

18. The liquid dispensing bottle of claim 14, wherein said weight has sufficient weight so that said weight moves with liquid inside said container said liquid dispensing bottle is tilted in any direction, and said weight is made from materials having density greater than 1.0 g/cm$^3$.

19. The liquid dispensing bottle of claim 14, wherein liquid dispensing mechanism is a pumping mechanism for spraying.

20. The liquid dispensing bottle of claim 14, wherein said liquid dispensing mechanism is a suction mechanism for attracting liquid from said liquid dispensing bottle.

* * * * *